US005259438A

United States Patent [19]

Badenhope

[11] Patent Number: 5,259,438

[45] Date of Patent: Nov. 9, 1993

[54] FRAMED PRINTOUT CORE FOR DIE AND CASTING

[75] Inventor: Robert I. Badenhope, Toledo, Ohio

[73] Assignee: Doehler-Jarvis Limited Partnership, Toledo, Ohio

[21] Appl. No.: 862,607

[22] Filed: Apr. 1, 1992

[51] Int. Cl.[5] ..... B22C 9/10; B22C 9/24; B22D 17/24

[52] U.S. Cl. ..... 164/113; 164/137; 164/312; 164/340; 164/369

[58] Field of Search ..... 164/369, 340, 137, 113, 164/312

[56] References Cited

U.S. PATENT DOCUMENTS

| | | | |
|---|---|---|---|
| Re. 31,488 | 1/1984 | Trumbauer | 164/32 |
| 3,756,309 | 9/1973 | Nishiyama et al. | 164/369 |
| 4,273,182 | 6/1981 | Winterhalter et al. | 164/137 |
| 4,913,217 | 4/1990 | Koch et al. | 164/340 |
| 4,942,917 | 7/1990 | Koch et al. | 164/369 |
| 4,972,897 | 11/1990 | Thomas | 164/35 |
| 4,981,168 | 1/1991 | Koch et al. | 164/137 |

FOREIGN PATENT DOCUMENTS

| | | | |
|---|---|---|---|
| 61-154753 | 7/1986 | Japan | 164/340 |
| 62-81247 | 4/1987 | Japan | 164/340 |
| 1-95859 | 4/1989 | Japan | 164/340 |
| 2-46948 | 2/1990 | Japan | 164/340 |

*Primary Examiner*—J. Reed Batten, Jr.
*Attorney, Agent, or Firm*—Hugh Adam Kirk

[57] ABSTRACT

The framed printout is connected to an expendable core for a high-pressure die casting die, which printout is spaced outside and surrounds the cavity in the die. The casting and its cavity in the die has at least one open side into which the core is positioned, such as to form a jacket around a cavity in a casting. The die has in its parting surface a pocket for seating the frame of the printout and its connections to the core, which pocket is spaced from and is outside the casting cavity in the die.

7 Claims, 4 Drawing Sheets

FRAMED PRINTOUT CORE FOR DIE AND CASTING

BACKGROUND OF THE INVENTION

The forming of printout pockets in the cavity of dies for positioning cores in the dies is well known, including printouts as shown in applicant's assignee's Koch et al U.S. Pat. No. 4,913,217 issued Apr. 3, 1990; 4,942,917 issued Jul. 24, 1990; and 4,981,168 issued Jan. 1, 1991.

SUMMARY OF THE INVENTION

The expendable core of this invention is for die casting dies for producing castings with at least one open end or side adjacent the parting surface of a die for the casting. This core is located in the cavity of the die that forms the casting and is held in position therein by a printout portion integrally connected to the core, but extending outwardly and spaced away from the periphery of the cavity for the casting in the die. This printout portion of the core frames or surrounds the casting cavity in the die and seats in a printout pocket formed in the parting surface of the die also spaced away from the periphery of the casting cavity. The closure of the die holds the printout in its pocket and correspondingly the core positioned in the die cavity. Printout connections are formed also integral with the core between the core per se and the frame of the printout remote from the core.

OBJECTS AND ADVANTAGES

It is an object of this invention to produce an efficient, effective, economic and simple expendable core for a die casting die.

Another object is to produce an expendable core for a die casting die that does not require a separate means for holding the core in position in the die, and thus is an improvement over the above cited Koch et al U.S. patents.

Another object of the core and framed printout therefor is to form easily a die casting having a cavity whose walls are substantially untapered, that is of a taper of one-half a degree or less.

Another object is to produce a casting in a high-pressure die casting die with an expendable core in which the casting has substantially uniform wall thickness, which walls are thin and thus have a dense surface requiring little, if any, machining.

Still another object is to produce a core which enables the production of the high-pressure die casting of reduced weight and less porosity.

A still further object is to provide an expendable core for an open-ended casting die, which core has good mechanical strength, is rigid, and maintains the location of the core in the die casting die, in spite of the fact that the printout for holding the core is spaced from the cavity in the die.

BRIEF DESCRIPTION OF THE VIEWS

The above mentioned and other features, objects and advantages, and a manner of attaining them are described more specifically below by reference to an embodiment of this invention shown in the accompanying drawings wherein.

DETAILED DESCRIPTION OF THE VIEWS

Figure 1:
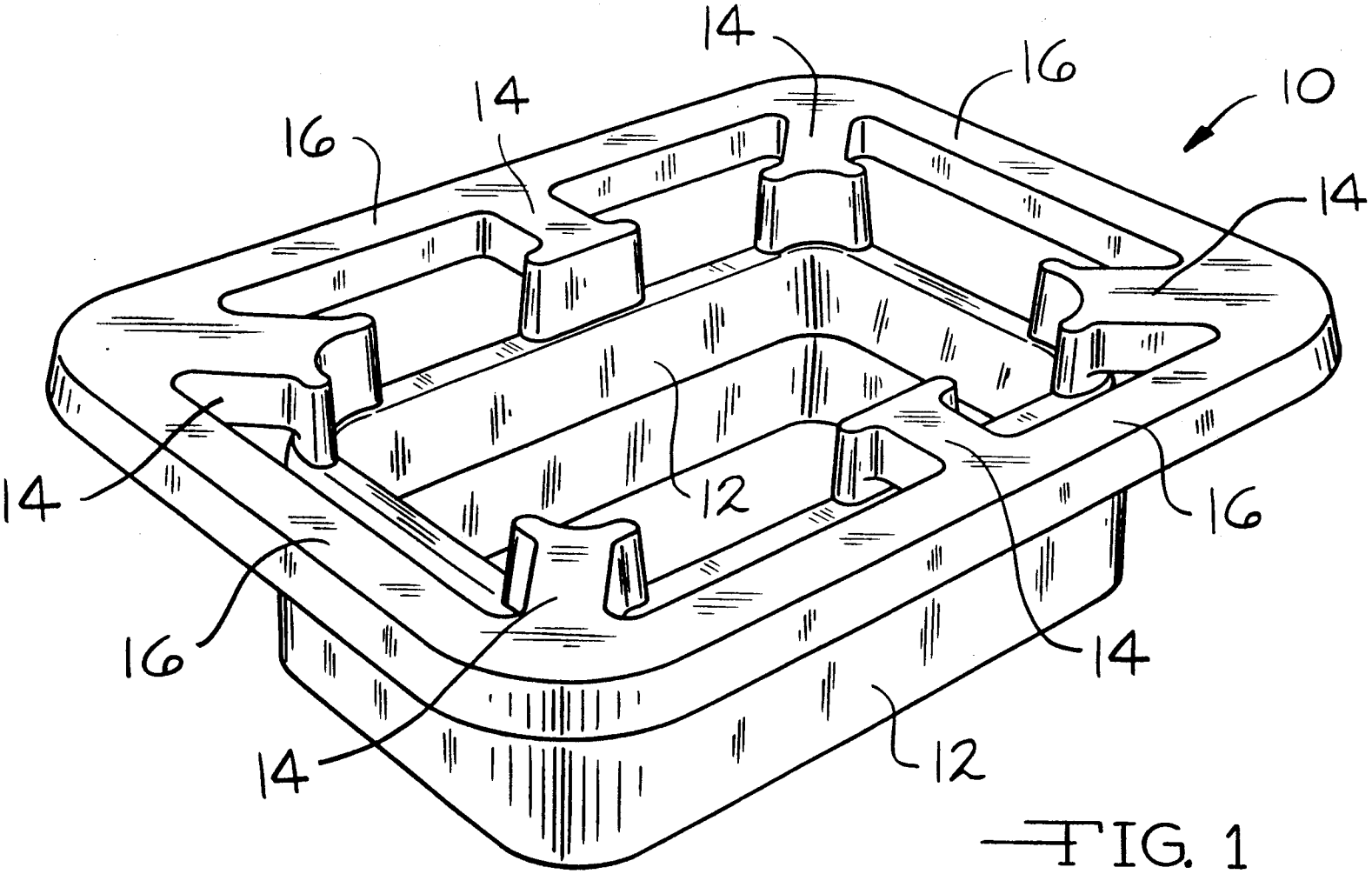
FIG. 1 is a perspective view of one embodiment of a core of this invention.

Referring first to FIG. 1, there is shown in perspective a view of one embodiment of an expendable framed core 10 for forming an elongated cavity in a casting. The core per se comprises a hollow portion 12 for forming a cavity in a casting, the upper edges of which portion 12 are integrally connected and bridged by printout connections 14 to a surrounding rectangular printout frame 16.

Figure 2:
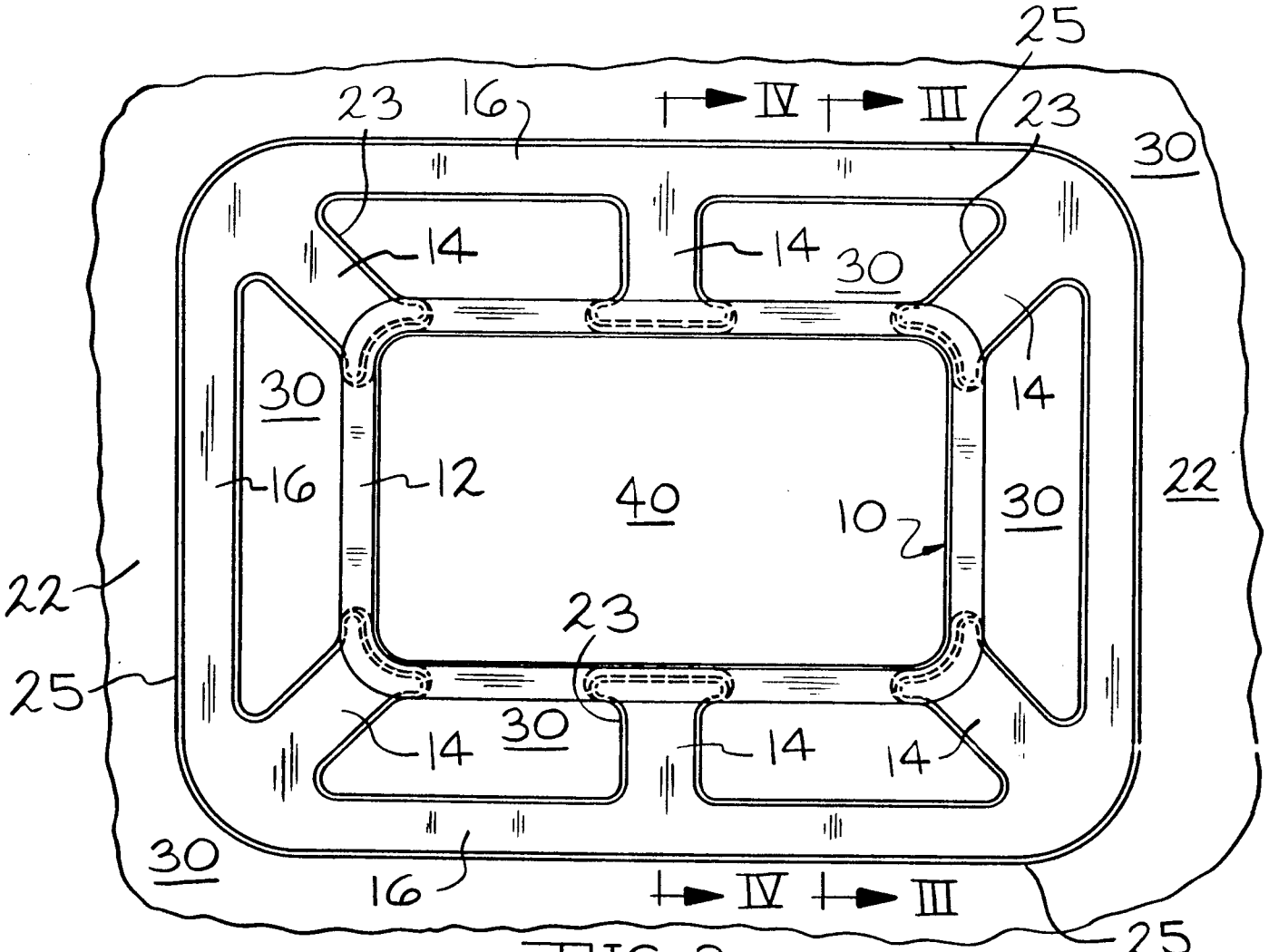
FIG. 2 is a view looking into the movable die when open with the core and its surrounding framed printout shown in FIG. 1 in position at the parting surface of the movable die, which movable die also contains pockets for the frame of the printout portion and its connections to the core.
Figure 3:
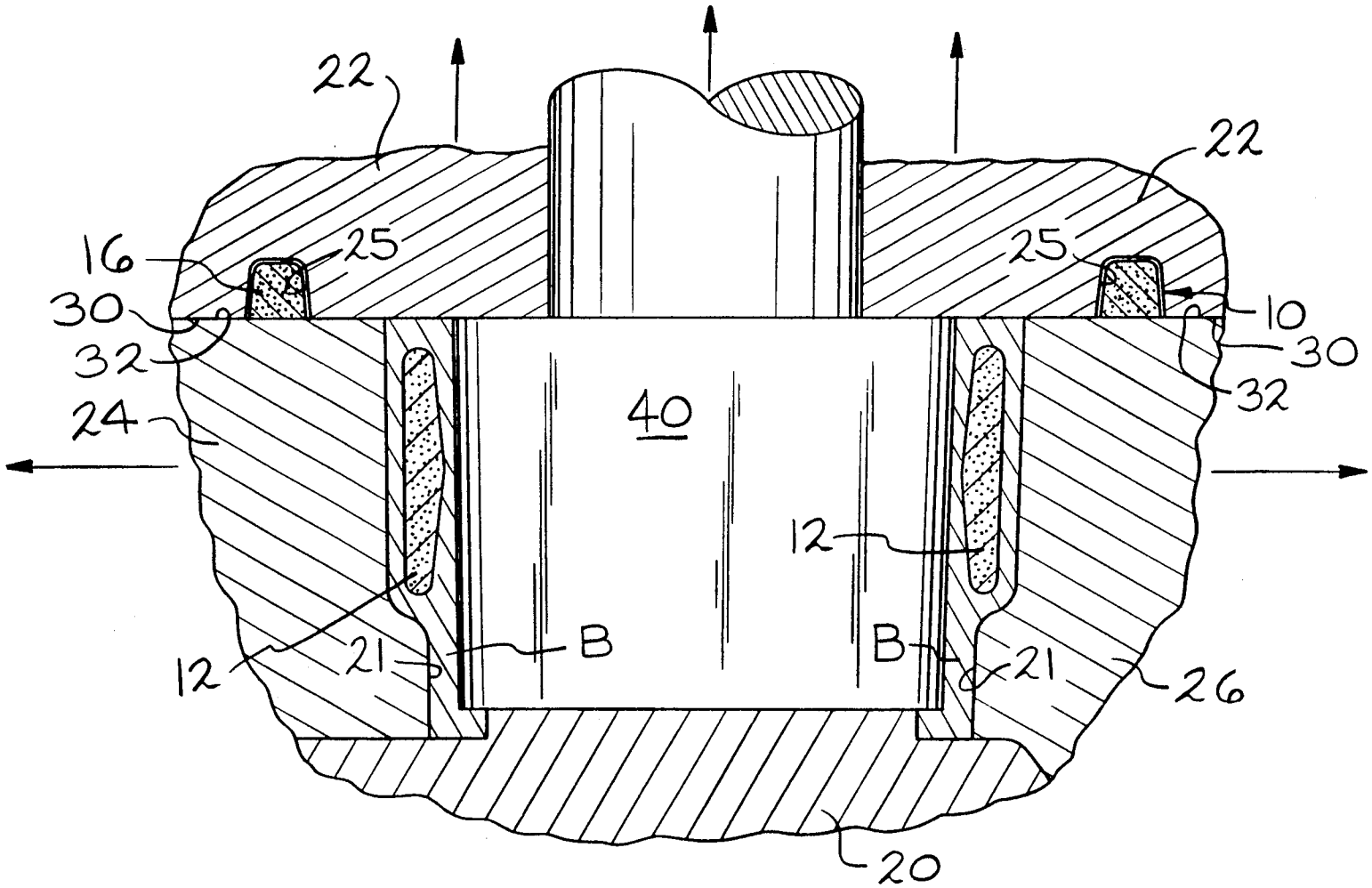
FIG. 3 is a section in the direction of the arrows III—III through the cavity portions of the closed die casting dies for forming a casting having a cavity formed by the core shown in FIGS. 1 and 2.
Figure 4:
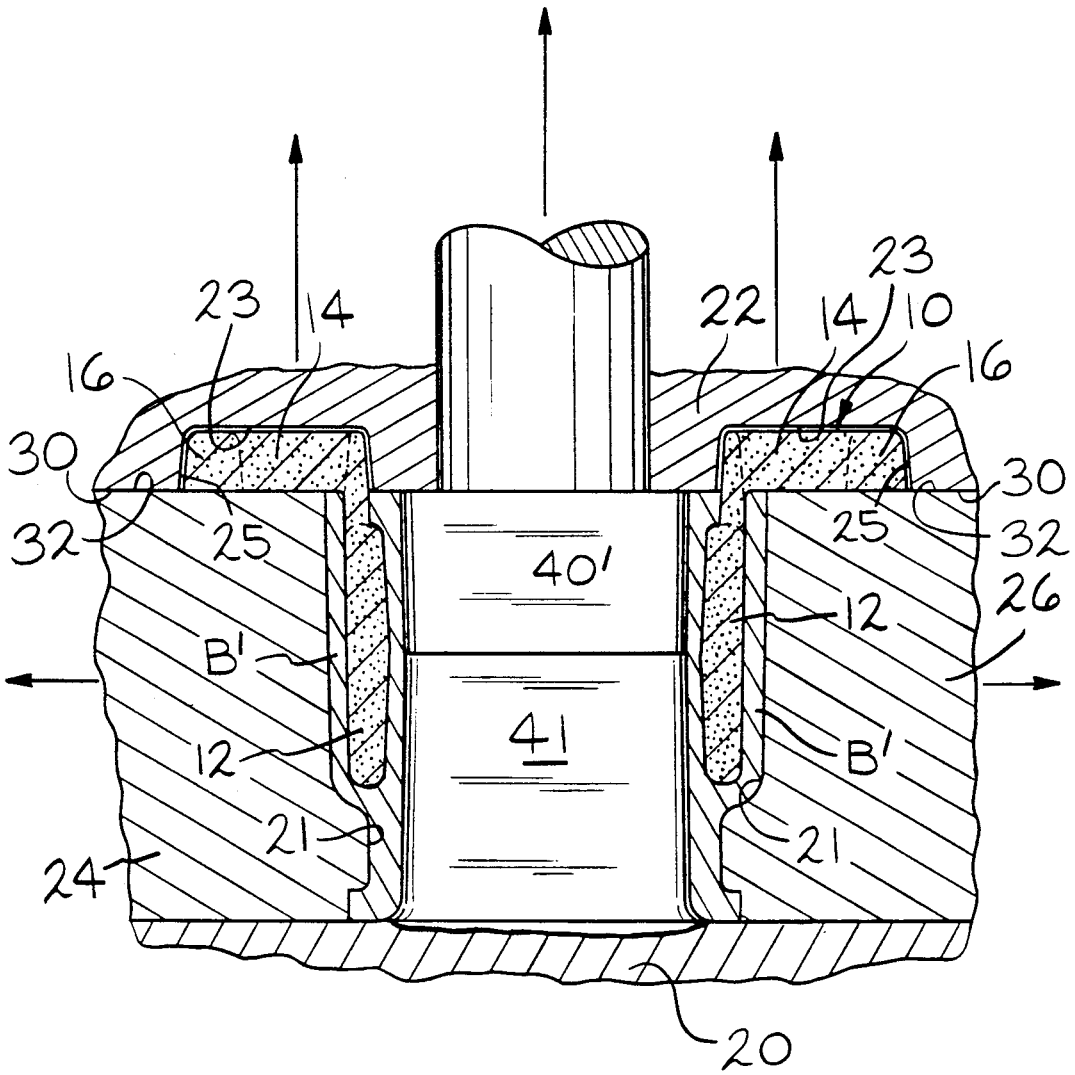
FIG. 4 is a section taken along lines IV—IV of the core shown in FIGS. 1 and 2 showing a different set of dies having a casting central cavity with walls of low taper and of a more uniform thickness than shown in FIG. 3.

Referring now to FIGS. 2 through 4, the specific core 10 is shown located in the pockets 23 and 25 and/or cavity 21 of the movable die 22 of closed die casting dies. Only the casting or molding portions of each of these dies are shown, the rest of the dies being broken away. The portions shown are the parting surfaces 30 and 32 in the movable and stationary dies 22 and 20, which parting surfaces contain the pockets and cavities for the core and its printout portion shown in FIGS. 1 and 2, plus the casting formed therein, namely the casting B or B'.

The die parts shown in FIGS. 2 through 4 comprise a stationary die 20 with a movable die 22 which carries the two opposing slides 24 and 26; the last three movable dies move in the direction of the arrows shown in FIGS. 3 and 4. In FIG. 2, only the movable die 22 is shown surrounding and seating the printouts 14 and 16 of the core 10.

In FIGS. 2, 3 and 4, there are also shown the steel mandrels or cores 40, 40' and 41 for forming the hollow inside of the castings B and B'. Steel mandrels 40 and 40' are fastened in the movable die 22. In FIG. 4, the steel cores 40' and 41 are attached to the movable and stationary dies 22 and 20, respectively, and only extend halfway through the hollow in the casting B' from each open end thereof. Thus a half or less degree of taper may be formed on the inside wall of the casting B' so that this wall is relatively thin and of substantially uniform thickness. This reduces the amount of machining that has to be done in the hollow portion. Accordingly, this feature reduces the thickness of the casting walls, improves the density of the casting, reduces porosity of the casting, reduces the weight of the casting, and produces a casting with more uniform wall thickness. Furthermore, a framed printout enables cores to be formed in core boxes without having to have undercutting movable parts in the core box.

Although the embodiment of this invention is directed to a core for a hollow casting, it should be clearly understood that other forms of hollow castings can be made with expendable cores with framed printouts, which castings are open on at least one side, namely that of the parting surfaces between the dies as shown in FIG. 2, and have other shaped expendable cores with framed printouts.

While there are described above the principles of this invention in connection with the specific apparatus, it is to be clearly understood that this description is made only by way of example and not as a limitation to the scope of this invention.

I claim:

1. An expendable core for an openable cavity in a casting die, said core having an integral printout portion, said printout portion comprising a frame spaced away outside and completely surrounding said core and having integral bridge connections between said surrounding frame and said core.

2. In a die casting die having movable and stationary parting surfaces and having a cavity therein with an open side at said parting surfaces, said movable parting surface having a printout pocket spaced away outside and surrounding an open end of said cavity, and an expendable core in said cavity, the improvement comprising: a printout frame completely surrounding said die cavity and being seated in said printout pocket, said printout frame being connected by a plurality of bridges to said core.

3. A method of forming a casting in a die according to claim 2, comprising injecting a molten metal into said die having said expendable core, letting said molten metal solidify in said die, removing said casting from said die, and separating said core from said casting.

4. An expendable core for a casting, said core having an elongated hollow part, said core comprising:

A) a plurality of printout bridge connections from one open side of said hollow part, and B) a printout frame completely surrounding and spaced away from said hollow part and being integrally attached thereto by said printout bridge connections, whereby said frame strengthens said core to resist better the pressures of hot metal and to form a more accurate casting.

5. A mold having: a parting surface, a cavity for a casting, and an expendable core according to claim 3 mounted in said cavity, said parting surface also having a pocket for said printout bridge connections and said printout frame, said pocket being spaced from said cavity.

6. A high-pressure die casting die having a movable die part cooperating with a stationary die part, said die parts comprising:

1) a die casting cavity, 2) a printout pocket separate and spaced away from and surrounding said cavity, 3) an expendable core extending inside said cavity, and 4) a printout frame completely surrounding and spaced away from and outside an end of said core, said frame being connected to said core by a plurality of bridging members, and said frame seats in said printout pocket for locating said core in said cavity.

7. A method of forming a casting in a die according to claim 6, comprising injecting a molten metal into said die having said expendable core, letting said molten metal solidify in said die, removing said casting from said die, and separating said core from said casting.

* * * * *